US006776188B1

(12) United States Patent
Rajewski

(10) Patent No.: US 6,776,188 B1
(45) Date of Patent: Aug. 17, 2004

(54) INJECTOR

(76) Inventor: Robert C. Rajewski, Box 1390, Stettler, Alberta (CA), T0C 2L0

( * ) Notice: Subject to any disclaimer, the term of this patent is extended or adjusted under 35 U.S.C. 154(b) by 0 days.

(21) Appl. No.: 10/662,308

(22) Filed: Sep. 16, 2003

(30) Foreign Application Priority Data

Jul. 21, 2003 (CA) ..... 2,435,642

(51) Int. Cl.[7] ..... F17D 3/00; B67D 3/00

(52) U.S. Cl. ..... 137/624.13; 251/30.01; 222/504

(58) Field of Search ..... 137/624.13, 624.12, 137/596.15, 596.16; 251/30.01; 222/504

(56) References Cited

U.S. PATENT DOCUMENTS 2,692,614 A * 10/1954 McLeod ..... 137/596.15
3,228,472 A * 1/1966 Rhoads, Jr. ..... 166/64
4,059,149 A * 11/1977 Harrison ..... 137/624.13
4,609,874 A * 9/1986 Reich ..... 137/624.13
4,748,011 A * 5/1988 Baize ..... 423/228
6,378,737 B1 * 4/2002 Cavallaro et al. ..... 222/504

* cited by examiner

*Primary Examiner*—Kevin Lee
(74) *Attorney, Agent, or Firm*—Anthony R. Lambert

(57) ABSTRACT

An injector injects fluids, such as hydrate inhibitors into a pipeline such as a natural gas pipeline. The injector is comprised of two motor valves with different force constants such that they open and close in a sequence that injects fluid into the pipeline. The motor valves are controlled by pressure in a control line, where the pressure in the control line is controlled by a latching solenoid valve that pressurizes and vents the control line, according to the signals received from a control panel. When used with a natural gas pipeline, the displaced natural gas captured by the overhead storage tank can be used to fuel a natural gas heater.

24 Claims, 4 Drawing Sheets

INJECTOR

BACKGROUND OF THE INVENTION

When fluids are transported in a pipeline, it is sometimes desired to inject other fluids into the pipeline. Pipelines rely on pressure to move their contents, and in high pressure pipelines, it can be difficult to inject the fluid. An example of this can be found in the petroleum industry, where, when transporting natural gas by pipeline, one must be concerned with the formation of hydrates in the pipeline, especially in colder climates or in offshore operations. Once the thresholds of temperature and pressure have been crossed, water and certain gas molecules such as methane and ethane, all of which may be found in natural gas, call precipitate from the gas being transported. As a result, the pipeline, valves, or other equipment used in the operation may become less efficient or even blocked. Commonly, liquids such as methanol, glycol or diethylene glycol are mixed with the gas to prevent the formation of hydrates by shifting the thermodynamic hydrate formation to lower temperatures and higher pressures. Other inhibitors that inhibit hydrate formation when present in smaller amounts are also currently being developed. Because of the pressure of the natural gas being transported, the problem is then how to inject the inhibitor into the pipeline.

A common practice in the petroleum industry is to use a diaphragm and plunger apparatus to inject hydrate inhibitors into the pipeline. The injection of the inhibitor is controlled by the plunger. As the plunger moves up, the inhibitor is drawn into a tube by opening a valve due to the reverse pressure created in the tube that connects the tube to a reservoir of the inhibitor. As the plunger moves down, the reservoir valve is closed, and another valve is opened that connects the tube to the pipeline. With the plunger applying more pressure than the pipeline, the valve is opened and the inhibitor is pushed into the pipeline. This process is then repeated. The motion of the plunger is controlled by a diaphragm above it. When the plunger is at its highest point, the diaphragm's side opposite the plunger is pressurized with gas from the pipeline, forcing it and the plunger downward. The difference in size between the diaphragm and plunger, for example, 10" and ¼" respectively, allows the plunger to apply a positive pressure on the inhibitor and inject it into the pipeline. Once the plunger reaches its lowest point, it trips a switch that causes the gas used to push the diaphragm downward to be vented. With the pressure released, the diaphragm returns to it original shape, and the plunger with it. This design suffers from a few problems. First, the gas used to pressurize the diaphragm is simply vented into the air, causing waste and pollution. Secondly, the setup is designed to inject a certain amount of inhibitor, and while it is possible to change this, the setup then becomes less efficient.

SUMMARY OF THE INVENTION

In a preferred embodiment of the invention, there is provided an injector for injecting fluids into a pipeline, the injector comprising a source of fluid to be injected; a first and a second motor valve, the first motor valve having a larger force constant and being connected to regulate flow between the source of fluid and a displacer tube, the second motor valve having a lesser force constant and being connected to regulate flow between the displacer tube and the pipeline; and a control line connected to the first and second motor valve for controlling the first and second motor valve.

The source of fluid may be an overhead storage tank. The control line may be pressurized and depressurized by a valve connected to the pipeline. The valve may be a latching solenoid valve. The latching solenoid valve may pressurize and depressurize the control line according to control signals provided by a control panel, the control panel may comprise a timing apparatus that provides control signals to the latching solenoid valve; and a power source connected to the latching solenoid valve for providing the latching solenoid with power. The pipeline may be used to transport natural gas. The injected fluid may be hydrate inhibitor. The power source may be a battery. The battery may be charged by a photovoltaic converter. The natural gas in the source of fluid may be used to fuel a heater. The timing apparatus may comprise a clock with a sweeping hand; a magnet carried by the second hand; and a plurality of magnetically operated switches, the switches positioned to be activated by sweeping the magnet past the magnetically operated switches. The magnetically operated switches may be reed switches. A plurality of magnets and a plurality of magnetically operated switches may be used to increase the frequency of switching.

In another preferred embodiment of the invention, there is provided a hydrate inhibitor injector for injecting hydrate inhibitor into a natural gas pipeline, the injector comprising a source of hydrate inhibitor; and first and second valves on a line connected to the source of hydrate inhibitor, the valves configured to isolate a slug of hydrate inhibitor in response to a first signal from a controller and deposit the slug of hydrate inhibitor in a natural gas pipeline in response to a second signal from the controller. The source of hydrate inhibitor may be an overhead storage tank. The natural gas in the overhead storage tank may be used to fuel a natural gas heater. The first and second valves may be motor valves with different force constants. The controller may comprise a control line; a valve for pressurizing the control line in response to a first control signal and depressurizing the control line in response to a second control signal; and a power source connected to the valve for providing power to the valve. The valve may be a latching solenoid valve. The first and second control signals may be provided by a timing apparatus comprising a clock with a sweeping hand; a magnet carried by the sweeping hand; and a plurality of magnetically operated switches, the switches positioned to be activated by sweeping the magnet past the magnetically operated switches. The magnetically operated switches may be reed switches.

BRIEF DESCRIPTION OF THE DRAWINGS

There will now be given a brief description of the preferred embodiments, by way of example, and not with the intent of limiting the scope of the invention, and in which:

FIGS. 2(*b*)–(*d*) shows a side view of the injection valves at they progress through the injection cycle.

DETAILED DESCRIPTION OF THE PREFERRED EMBODIMENTS

In this disclosure, the use of the indefinite article "a" does not exclude the possibility that more than one element is present, unless the context clearly requires that there be only one of the elements.

Figure 1:
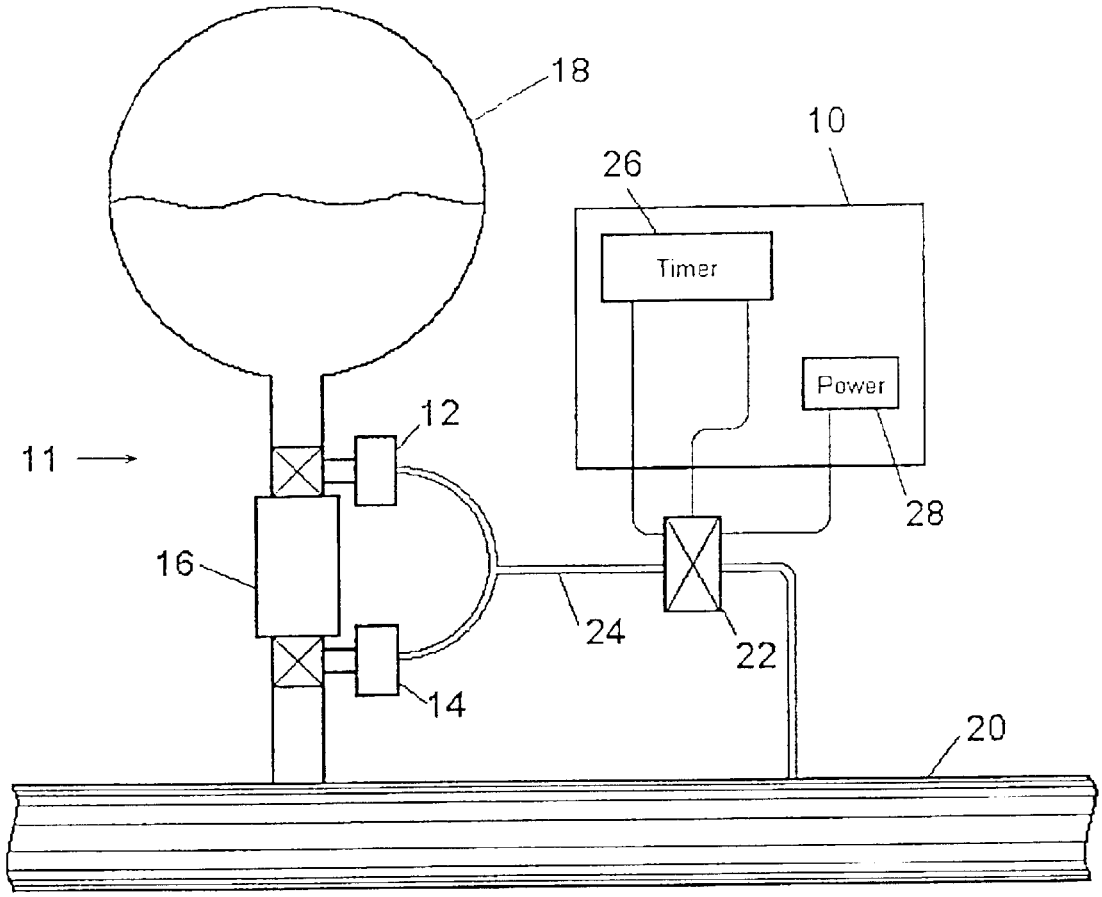
FIG. 1 shows the injector apparatus.
Figure 2A:
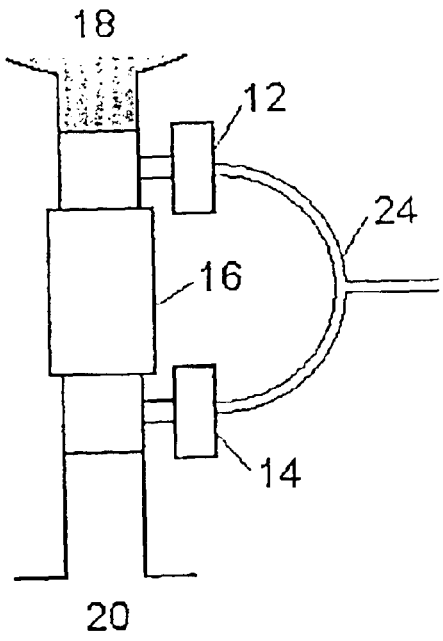
FIG. 2(*a*) shows the injection valve system.
Figure 2B:
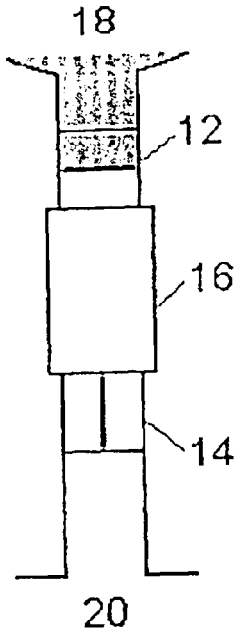
Figure 2C:
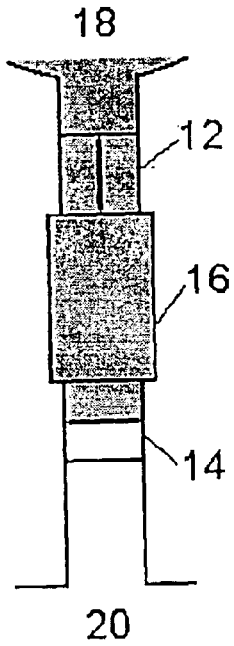
Figure 2D:
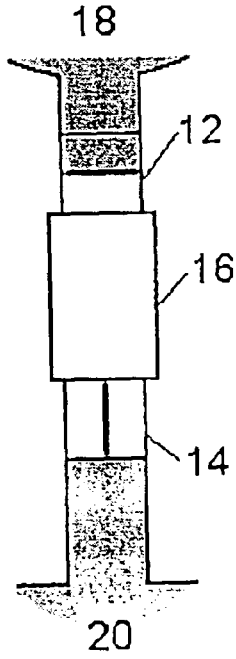

Referring to FIG. 1, there is shown an injector 11 for injecting fluids into a pipeline 20. A source 18 of fluid to be injected, such as hydrate inhibitor, is situated above the first motor valve such that the displacer tube 16 fills. Preferably, the tank is an overhead storage tank. There is also shown a first and a second motor valve 12 and 14, the first motor valve 12 having a larger force constant and being connected to regulate flow between the source of fluid and a displacer tube 16, the second motor valve 14 having a lesser force constant and being connected to regulate flow between the displacer tube 16 and the pipeline 20. Connected to the first and second motor valve 12 and 14 is a control line 24 which controls the first and second motor valve 12 and 14. At the other end of the control line 24 is a control valve 22 that pressurizes and depressurizes the control line 24. The control valve can be a latching solenoid valve such as a Skinner brand solenoid from the Parker Hannifin Corporation of Cleveland, Ohio. The operation of the latching solenoid valve is controlled by a control panel 10.

The operation of a preferred embodiment will now be discussed with reference to FIGS. 2(*a*)–(*d*). The apparatus will inject the desired fluid as the motor valves 12 and 14 that have different force constants are opened and closed in a specific sequence to fill the displacer tube 16 with fluid from the overhead storage tank 18 and then to inject the fluid into the pipeline 20. In this example, motor valve 12, which is closed when there is no force acting upon it, has a higher force constant than motor 14, which is open when there is no force acting upon it. Both motor valves 12 and 14 must have a force constant less than the operating pressure of the pipeline 20. The latching solenoid valve 22 opens and closes according to the control signals it receives from the control panel 10. If we begin our consideration by assuming that the solenoid valve 22 is closed, then there is no pressure in the control line 24, and motor valve 12 will be closed while motor valve 14 will be open. In these positions, the displacer tube 16 will fill with the fluid being transported from the pipeline 20. When a signal is received from the control panel 10, the solenoid valve 22 will open and the control line 24 will fill with the fluid being transported at a pressure equal to that of the pipeline 20. This pressure will force motor valve 14 to close and motor valve 12 to open. Note that, because motor valve 12 has a higher force constant than motor valve 14, motor valve 14 will close before motor valve 12 opens. As a result, the fluid in the displacer tube 16 will be released into the overhead storage tank 18, and the displacer tube 16 will fill with the fluid from the overhead storage tank, or a slug of fluid. When another signal is received from the control panel 10, the solenoid valve 22 will close off connection to the pipeline 20 and vent the control line 24. As the pressure drops in the control line 24, motor valve 12 will close first and then motor valve 14 will open. The fluid originating from the storage tank will drain into the pipeline 20, and the displacer tube 16 will fill with fluid from the pipeline, and the process can be repeated. Note that the size of the displacer tube 16 can be varied and will depend upon the rate of fluid injection required. It can also be noted that the fluid released into the storage tank is related directly to the amount of fluid injected and thus no extra waste is caused by changing the displacer tube 16. This arrangement is possible when the density of the fluid to be injected is greater than that of the fluid being transported.

FIGS. 2(*a*)–(*d*) shows the operation of the valves 12 and 14 at each step of the procedure, with the grey shading representing the location of the fluid to be injected. As an example, we will consider injecting a hydrate inhibitor, methanol, into a natural gas pipeline, to which this apparatus lends itself proficiently. FIG. 2(*a*) is a view of the valve system, with the control line 24 shown. FIGS. 2(*b*)–(*d*) are side views of the valve system. In FIG. 2(*b*), valve 12 is open, while valve 14 is closed. The displacer tube 16 is filled with natural gas from the pipeline 20. FIG. 2(*c*), valve 14 has closed, and valve 12 has opened. The natural gas is released into the overhead storage tank 18, and the displacer tube 16 fills with methanol. In FIG. 2(*d*), valve 12 closes while valve 14 opens again, allowing the methanol to flow into the pipeline 20, and methanol to fill the displacer tube 16.

Figure 3:
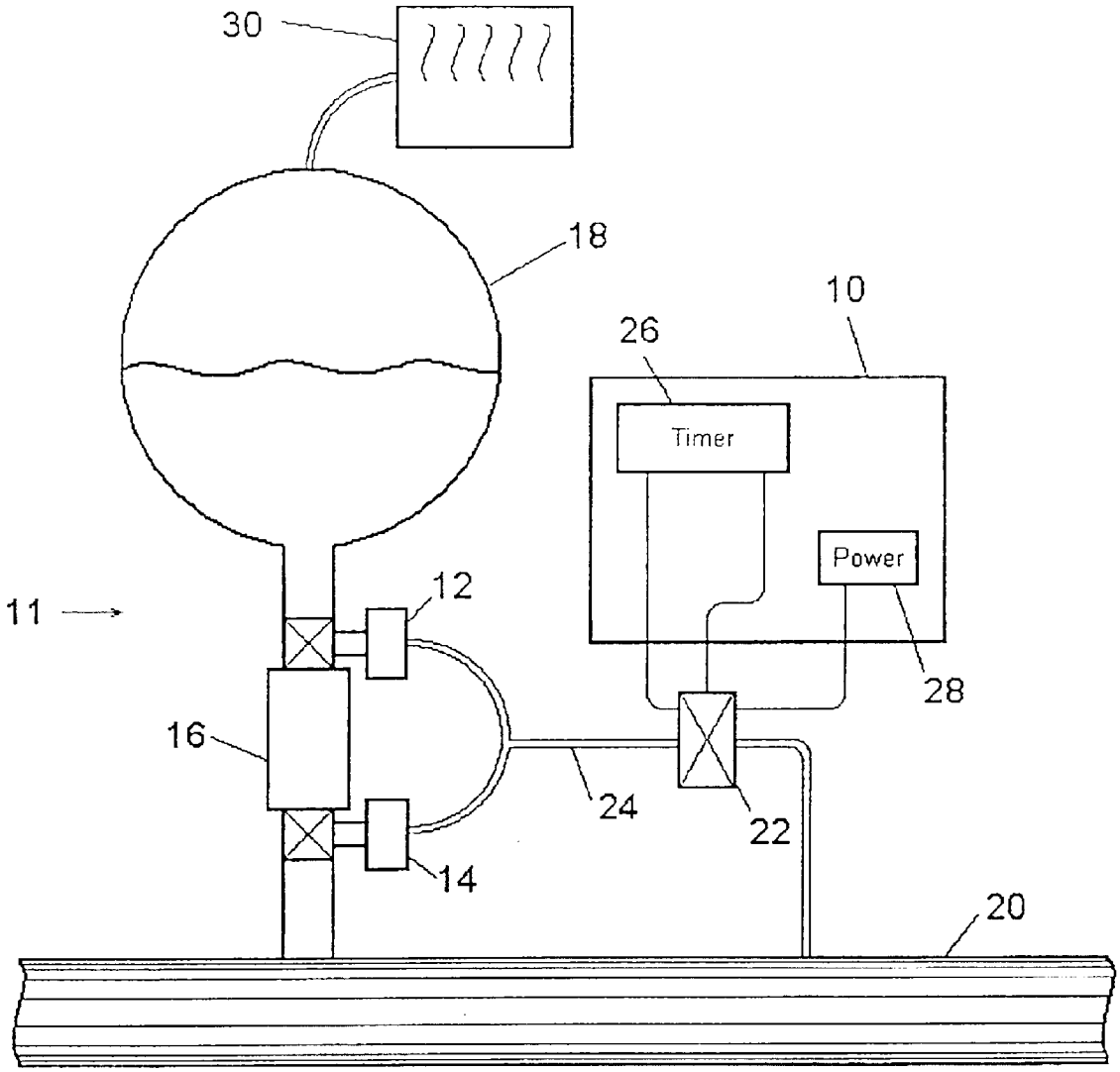
FIG. 3 shows a preferred embodiment being used in the petroleum industry, where the natural gas in the overhead storage tank is used to fuel a heater.

When natural gas is being transported, the overhead storage tank 18 will fill with pressurized natural gas as it is released from the displacer tube 16. According to a preferred embodiment, this gas can then used to fuel a heater 30 such as a Cata-Dyne™ heater built by Thermal Technologies of Edmonton, Alberta, as shown in FIG. 3.

Another aspect of the injector is the control panel 10 that includes a timing apparatus 26 to control the latching solenoid valve 22, and a power source 28 to supply the valve with power. The timing apparatus 26 sends alternating pulses that cause the solenoid valve 22 to open and close. It can be any device known in the art that is capable of initiating two pulses periodically. For example, an electronic control device could be formed using a circuit based on the 555 timer. In a preferred embodiment, we use a clock 42 with a sweeping hand 44, where the sweeping hand triggers switches 40. In one embodiment, the sweeping hand 44 is the second hand, although any sweeping hand can be used, and it carries a magnet 46 that periodically passes by switches 40 that close in the presence of a magnetic field, such as a reed switch commercially available from, for example, Reed Switch Developments Corp. of Racine, Wis., are closed, sending control pulses to the solenoid. In a further embodiment, switches may for example use interruption of a light path to trigger the switch. In this case, the switch may use a combination of a light emitter and a photodetector, and the magnet is not required, the switch being activated by the passage of the sweeping arm past the switch and interrupting the light path between the light emitter, such as a light emitting diode, and the photodetector.

Figure 4:
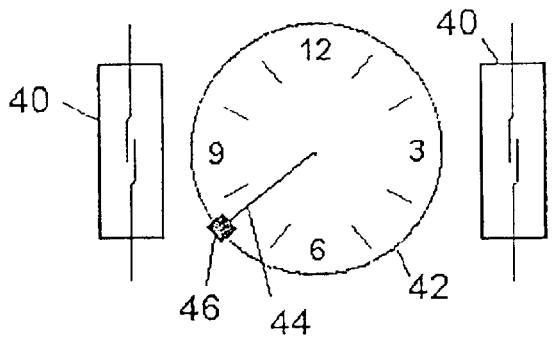
FIG. 4 shows a timing apparatus to be incorporated in the control panel.
Figure 5:
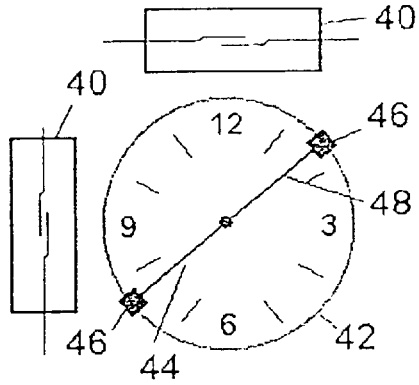
FIG. 5 shows a timing apparatus with a higher switching frequency.

A variety of arrangements are available for this apparatus. The basic arrangement is shown in FIG. 4 and comprises two switches 40 on opposite sides of the clock 42, such that each switch 40 will close once a minute, and 30 s after the switch 40 on the opposite side. By using this design, the frequency is not limited to a period of 60 seconds. By incorporating other hands 48 attached to the second hand in other positions, and either adding more switches 40 or repositioning the ones in use, a variety of periods can be produced. An example is shown in FIG. 5, where two switches 40 are placed a quarter of a revolution apart, and another magnet 46 is attached to an extra second hand 48, which is connected to and opposite the original second hand 44. This arrangement allows the user to reduce the solenoid valves switching period to 30 seconds rather than 60 seconds, and is equivalent to using four reed switches evenly spaced around the clock, two for each signal, with a single sweeping hand and magnet.

Figure 6:
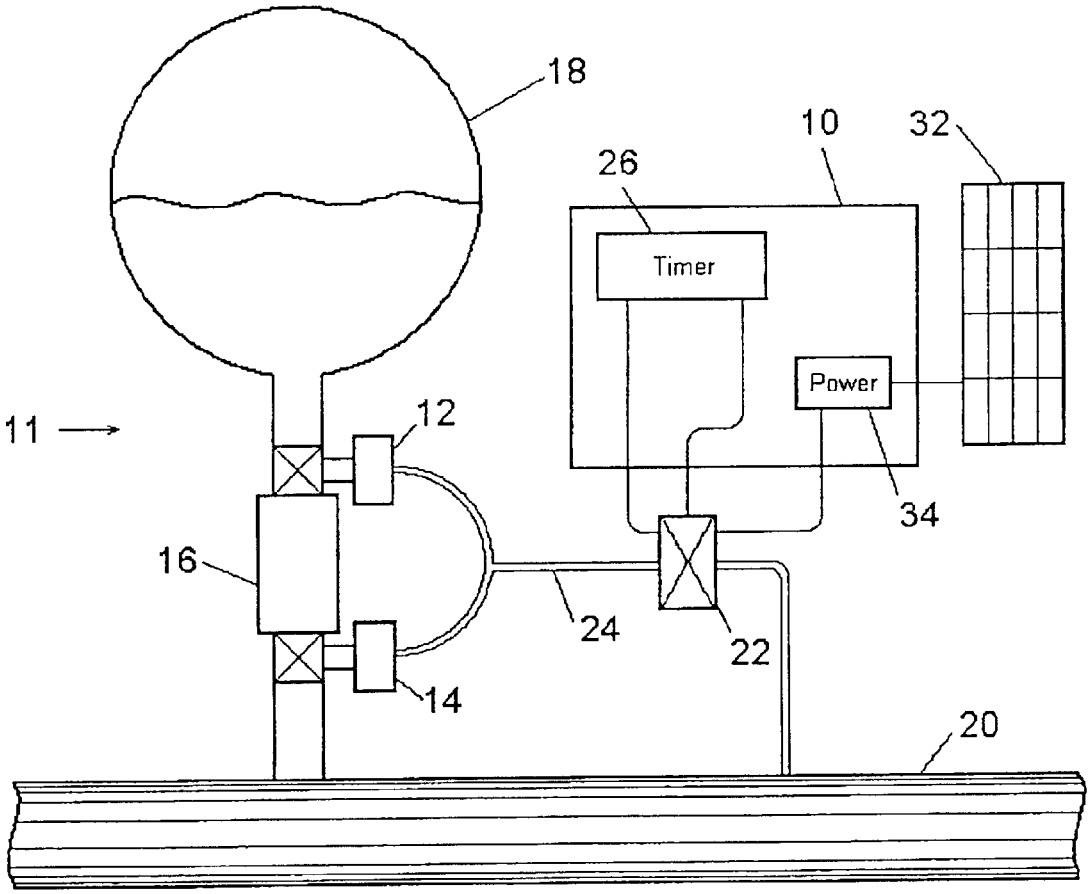
FIG. 6 shows a preferred embodiment where the solenoid valve of the injector is powered by a battery, and the battery is charged by a photovoltaic converter.

In a preferred embodiment as shown in FIG. 6, the solenoid valve 22 is powered by a battery 34 so that the methanol injection system can be used in remote locations. The battery 34 can be connected to a photovoltaic converter 32, such as those available from Siemens, that charges the battery 34, allowing for an extended life in remote locations.

Immaterial modifications may be made to the embodiments described herein by a person skilled in the art without departing from the invention.

What is claimed is:

1. An injector for injecting fluids into a pipeline, the injector comprising:

a source of fluid to be injected;

a first and a second motor valve the first motor valve having a larger force constant and being connected to regulate flow between the source of fluid and a displacer tube, the second motor valve having a lesser force constant and being connected to regulate flow between the displacer tube and the pipeline; and a control line connected to the first and second motor valve for controlling the first and second motor valve.

2. The injector of claim 1 in which the source of fluid is an overhead storage tank.

3. The injector of claim 1 in which the control line is pressurized and depressurized by a valve connected to the pipeline.

4. The injector of claim 3 in which the valve is a latching solenoid valve.

5. The injector of claim 1 in which the pipeline is used to transport natural gas.

6. The injector of claim 5 in which the fluid is hydrate inhibitor.

7. The injector of claim 5 in which the natural gas in the source of fluid is used to fuel a heater.

8. The injector of claim 4 in which the latching solenoid valve pressurizes and depressurizes the control line according to control signals provided by a control panel, the control panel comprising:

a timing apparatus that provides control signals to the latching solenoid valve; and a power source connected to the latching solenoid valve for providing the latching solenoid with power.

9. The injector of claim 8 in which the power source is a battery.

10. The injector of claim 9 in which the battery is charged by a photovoltaic converter.

11. The injector of claim 8 in which the timing apparatus comprises:

a clock with a sweeping hand; and a switch positioned to be activated by passage of the sweeping hand past the switch.

12. The injector of claim 11 in which the timing apparatus comprises:

a clock with a sweeping hand;

a magnet carried by the sweeping hand; and a plurality of magnetically operated switches, the switches positioned to be activated by sweeping the magnet past the magnetically operated switches.

13. The injector of claim 12 in which the magnetically operated switches are reed switches.

14. The injector of claim 11 in which a plurality of sweeping hands are mounted on the clock and move with the sweeping hand, each of the plurality hands being positioned in relation to the switch to operate the switch.

15. The timing apparatus of claim 12 in which a plurality of sweeping hands are mounted on the clock and move with the sweeping hand, and each the plurality of sweeping hands carrying a magnet such that the frequency of switching is increased.

16. A hydrate inhibitor injector for injecting hydrate inhibitor into a natural gas pipeline, the injector comprising:

a source of hydrate inhibitor; and a first valve and a second valve on a line connected to the source of hydrate inhibitor, the first valve and the second valve being configured to isolate a slug of hydrate inhibitor in response to a first signal from a controller and deposit the slug of hydrate inhibitor in a natural gas pipeline in response to a second signal from the controller.

17. The hydrate inhibitor injector of claim 16 in which the source of hydrate inhibitor is an overhead storage tank.

18. The hydrate inhibitor injector of claim 17 in which the natural gas in the overhead storage tank is used to fuel a natural gas heater.

19. The hydrate inhibitor injector of claim 16 in which the first valve has a first force constant and the second valve has a second force constant differing from the first force constant.

20. The hydrate inhibitor injector of claim 19 in which the controller comprises:

a control line;

a control line valve for pressurizing the control line in response to a first control signal and depressurizing the control line in response to a second control signal;

a power source connected to the control line valve for providing power to the control line valve.

21. The hydrate inhibitor injector of claim 20 in which the control line valve is a latching solenoid valve.

22. The hydrate inhibitor injector of claim 20 in which the first control signal and the second control signal are provided by a timing apparatus comprising:

a clock with a sweeping hand; and a switch positioned to be activated by passage of the sweeping hand past the switch.

23. The hydrate inhibitor injector of claim 20 in which the first control signal and the second control signal are provided by a timing apparatus comprising:

a clock with a sweeping hand;

a magnet carried by the sweeping hand; and a plurality of magnetically operated switches, the switches positioned to be activated by sweeping the magnet past the magnetically operated switches.

24. The hydrate inhibitor injector of claim 23 in which the magnetically operated switches are reed switches.

* * * * *